US006582533B2

(12) United States Patent
Tukeda et al.

(10) Patent No.: US 6,582,533 B2
(45) Date of Patent: Jun. 24, 2003

(54) MAGNESIUM ALLOYS EXCELLENT IN FLUIDITY AND MATERIALS THEREOF

(75) Inventors: Tadayoshi Tukeda, Hiroshima (JP); Akihiro Maehara, Hiroshima (JP); Katsuhiko Nuibe, Hiroshima (JP); Ryouhei Uchida, Hiroshima (JP)

(73) Assignee: The Japan Steel Works, Ltd., Tokyo (JP)

( * ) Notice: Subject to any disclaimer, the term of this patent is extended or adjusted under 35 U.S.C. 154(b) by 0 days.

(21) Appl. No.: 09/777,679

(22) Filed: Feb. 7, 2001

(65) Prior Publication Data

US 2001/0026768 A1 Oct. 4, 2001

(30) Foreign Application Priority Data

Mar. 3, 2000 (JP) ..... 2000-059143

(51) Int. Cl.[7] ..... C22C 23/00

(52) U.S. Cl. ..... 148/420; 420/407; 420/410; 420/408; 420/409

(58) Field of Search ..... 148/420; 420/407, 420/410, 408, 409

(56) References Cited

U.S. PATENT DOCUMENTS 4,543,234 A * 9/1985 Foerster ..... 420/409
4,997,622 A * 3/1991 Regazzoni et al. ..... 420/407

FOREIGN PATENT DOCUMENTS

| | | | |
|---|---|---|---|
| DE | 2342633 | * | 3/1975 |
| EP | 799901 | * | 10/1997 |
| GB | 1303789 | * | 1/1973 |
| JP | 46016246 | * | 5/1971 |
| JP | 46016247 | * | 5/1971 |

* cited by examiner

*Primary Examiner*—Sikyin Ip
(74) *Attorney, Agent, or Firm*—Sughrue Mion, PLLC

(57) ABSTRACT

Magnesium alloys containing, by mass percent, Al: 10.0 to 13.0%, Si: 0.3 to 1.5%, Mn: 0.1 to 1.0%, and, if desired, Zn: less than 0.8%, the rest being Mg and unavoidable impurities. Neither cracking by the casting is invited nor the mechanical property is spoiled, and the fluidity can be notably improved, and it is possible to make products small in thickness and light in weight.

2 Claims, 9 Drawing Sheets

INFLUENCE OF Al CONTENT ON ELONGATION AT ROOM TEMPERATURE

INFLUENCE OF Al CONTENT ON YIELD STRENGTH AT ROOM TEMPERATURE

INFLUENCE OF Al CONTENT ON TENSILE STRENGTH AT ROOM TEMPERATURE

INFLUENCE OF Al CONTENT ON ELONGATION AT ROOM TEMPERATURE

MAGNESIUM ALLOYS EXCELLENT IN FLUIDITY AND MATERIALS THEREOF

BACKGROUND OF INVENTION

1. Field of Invention

The present invention relates to magnesium alloys excellent in fluidity and suited for various high pressure casting processes such as a metal injection molding, a die casting or a squeeze casting, and to materials of said magnesium alloys produced by injection of half molten metal.

2. Related Technolgy

Because magnesium alloy has a characteristic of light in weight and high in strength, a magnesium alloy has been used to such as cases of electronic portable devices, and gradually widened application ranges and amounts. For making these members hitherto, there have broadly been employed various high pressure casting processes such as metal injection moldings, die castings or squeeze castings.

As magnesium alloys available to the high pressure casting, the following Mg—Al based alloys have been standardized. Numerical values shown under are mass % as a unit.

(1) Multi-purposed alloy 9Al-0.6 Zn-0.3 Mn-Rest Mg (AZ91D)

(2) High ductile alloy 6Al-0.3 Mn-Rest Mg (AM60B)

(3) High ductile alloy 5Al-0.3 Mn-Rest Mg (AM50A)

(4) High ductile alloy 2Al-0.3 Mn-Rest Mg (AM20)

(5) Heat resistant alloy 4Al-1 Si-0.4 Mn-Rest Mg (AS41B)

(6) Heat resistant alloy 2Al-1 Si-0.2Zn-0.4 Mn-Rest Mg (AS21)

(7) Heat resistant alloy 4Al-2 Mm-0.3Mn-Rest Mg (AE42)

These magnesium alloys are regarded to have relatively high strength, exhibit good flow of molten metal also in the casting process. For example, AZ91D alloy as the multi-purposed alloy is good not only in the fluidity but also in the strength and corrosion resistance, and it has been used, as a balanced alloy, to major parts (about 90%) of products of magnesium alloys.

Recently, electronic portable devices have been demanded to have lighter weight, and casings of thickness being 1 mm or smaller and lighter weight are required. However, in the prior magnesium alloy (such as AZ91D) having the relatively good fluidity, in case products of small thickness as 1 mm or lower are about to be made through the high pressure casting process, there occur problems of easily causing defects in surface owing to bad flow of a molten metal, decreasing a yield of production.

SUMMARY OF INVENTION

The invention has been realized against a background of the above circumstances, and it is an object of the invention to provide magnesium alloys having a more improved fluidity in comparison with prior materials and applicable to production of products of thinner thickness, and to provide materials of magnesium alloys produced by the injection molding process using the above mentioned alloys.

For solving the above mentioned problems, among the inventive magnesium alloys, a first invention is characterized by containing by mass percent Al: 10.0 to 13.0%, Si: 0.3 to 1.5%, and Mn: 0.1 to 1.0%, the rest being Mg and unavoidable impurities.

The magnesium alloys of the second invention are characterized by containing by mass percent Al: 10.0 to 13.0%, Si: 0.3 to 1.5%, Mn: 0.1 to 1.0%, and Zn: less than 0.8%, the rest being Mg and unavoidable impurities.

The magnesium alloys of the third invention are characterized by further containing by mass percent 10 ppm to 0.1% in total amount one kind or two kinds or more of Be, Ca, Sr, Ba and Mm (mesh metal) in the magnesium alloys as set forth in the first or second inventions.

The materials of magnesium alloys of the fourth invention are characterized in that the instant materials are produced by an injection molding process of injecting alloys as set forth in any of the first to third inventions under the semi solid condition being 50% or less in solid phase rate into the die.

DETAILED DESCRIPTION OF PREFERRED EMBODIMENTS

Figure 1:
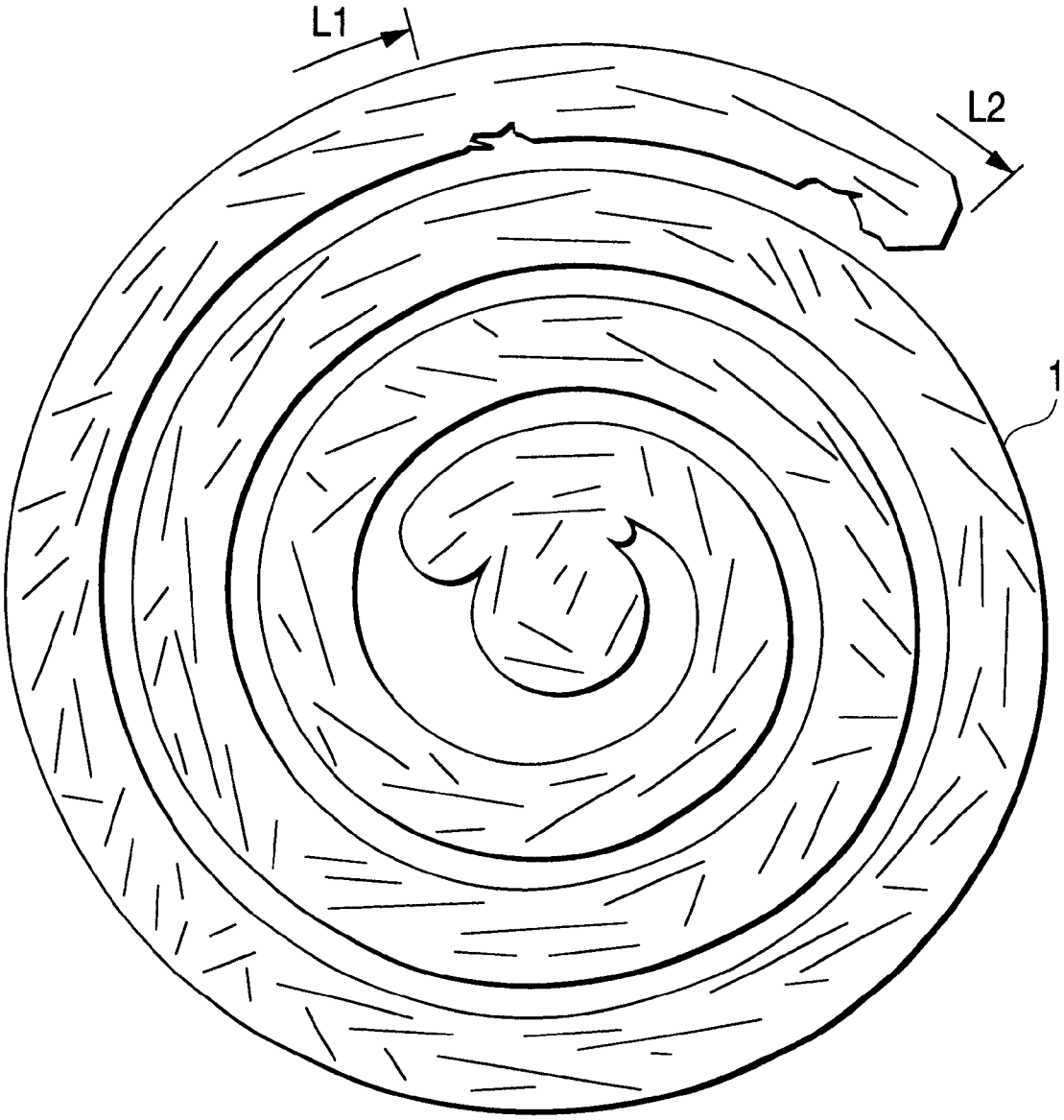
FIG. 1 is a view showing the formed body used in the Example.

Explanation will be made to the workings by the components of the inventive magnesium alloys and reasons for defining the containing amounts thereof.

Al: 10.0 to 13.0%

Al decreases melting points and solidus temperatures at and increases latent heat to heighten the fluidity. Besides, it is scarcely made solid in Mg base phase, but is concentrated prior to solidification of Mg primary crystal, so that the good fluidity is maintained until forming eutectic compound with Mg when solidifying. After solidification, the strength is increased by dispersed strength through eutectic compound with Mg. If the Al amount is less than 10.0%, the strength is not enough provided. On the other hand, if being higher than 13.0%, $Mg_{17}Al_{12}$ as an intermetallic compound being high in strength and brittle is much crystallized to extremely lower ductility and easily generate cracks by casting. For these reasons, the containing amount of Al is determined to be in the above range. For the same reasons, it is preferable to set the lower limit as 10.2% and the upper limit as 12.8%.

Si: 0.3 to 1.5%

Si forms the intermetallic compound as $Mg_2Si$ in relation with Mg, and causes eutectic reaction in relation with Al to crystallize eutectic Si. These substances each contribute to the increase of the latent heat and heightens the fluidity. For providing the above workings, the Si content of 3% or more is necessary. In contrast, exceeding 1.5%, elongation is lowered, and so the Si containing amount is determined to be in the above range. For the same reasons, it is preferable to set the lower limit as 0.4% and the upper limit as 1.4%.

Mn: 0.1 to 1.0%

Mn combines with Al to form the intermetallic compound, and controls deterioration of the corrosion resistance by making Fe as an impure element solid in Mn. For fully obtaining these workings, Mn of 0.1% or more is necessary, and being less than 0.1%, an effect is insufficient. But containing Mn more than 1.0%, a yield of solubility in the molten metal goes down, and so the Mn containing amount is determined to be in the above range. For the same reasons, it is preferable to set the lower limit as 0.2% and the upper limit as 0.9%.

Zn: less than 0.8%

Since Zn lowers the melting points, it may be contained if desired, but being more than 0.8%, cracks by casting are easy to occur, and therefore, the content is less than 0.8%. For the same reasons, it is preferable to set the upper limit as 0.7%.

Be, Ca, Sr, Ba, Mm: 10 ppm to 0.1%

These elements work to control oxidation of the molten metal while maintaining the high fluidity, and are useful for prevention of combustion. Therefore one kind or more may be contained if desired. For fully providing this effect, 10 ppm or more in total is necessary, and being less than 10 ppm, the prevention of combustion is not sufficient. On the other hand, exceeding 0.1% in total, the yield of solubility in the molten metal goes down, and a problem appears that such containing is not only useless, but easy to generate cracks during casting. Therefore, the containing amount in total of these elements is determined as the above range. For the same reasons, it is preferable to set the lower limit as 20 ppm and the upper limit as 800 ppm.

The magnesium alloy of the invention is melted aiming at the above element ranges, but the invention makes no especial limitation to a metal melting method, and an ordinarily practiced method can be employed. A molten magnesium alloy can be supplied to the casting process being a post procedure while keeping the metal molten or after once slabbing.

As the casting method in the casting step, generally known processes may be adopted, but since the magnesium alloy of the invention has a superior casting property and with respect to a require for the casting property, this is the suitable material for the high pressure casting process such as the die casting, the squeeze cast or the metal injection molding which may produce materials of high qualities.

To the requirements in these casting processes, the invention makes no especial limitations, but in the injection molding process under the half molten condition, it is preferable that the solid phase rate of the molten metal is 50% or less. Because if exceeding 50%, the fluidity of the molten metal goes down even in the inventive alloy having the good casting property, and a desirable injection molding would be probably difficult.

In the high pressure casting process, as the molten alloy (also including the half molten condition) has the high fluidity, the casting can be performed under the good flowing of the molten metal for forming products of thin thickness, and a yield of high production may be obtained. In addition, produced members have less defects by the preferable flow of the molten metal, and the excellent properties are secured also in the materials of high strength.

Accordingly, the formed products by the inventive alloy may be used as members of light weight and high strength in various applications. Thus, it may be expected to broaden using amounts to many kinds of portable devices, and to broaden usage to electrical tools or leisure equipment. Furthermore, the products of the magnesium alloys can be re-cycled in comparison with the existing plastic products, enabling contributing to preservation of the environment.

EXAMPLES

Further explanation will be made to the examples of the invention.

The magnesium alloys (the inventive materials) of the invention, alloys outside of the inventive ranges for comparison and the existing alloy (AZ91D) were melted respectively with the test samples shown in Table 1. Obtained ingots were cut and raw material chips (about 2 mm) were produced. These chips were made raw material, the metal injection molding process (the mold clamping force: 450 t) being one of high pressure casting processes was adopted, a spiral fluidity evaluating die (not shown) was prepared for obtaining a spiral body 1 of a shape shown in FIG. 1 (thickness: 2 mm and width: 15 mm), and the forming was carried out at the barrel temperature and the injecting speed as under shown for evaluating the fluidity. In the evaluation of the fluidity, for forming the spirally formed body, as shown in FIG. 1, if a distance where the molten metal got to a remotest part was L2, irrespective of presence or absence of breakage in the filling of the molten metal, and a distance without breakage where the molten metal perfectly got to was L1, L1 was used as a flowing length of filling the molten metal for the evaluation.

Figure 2:
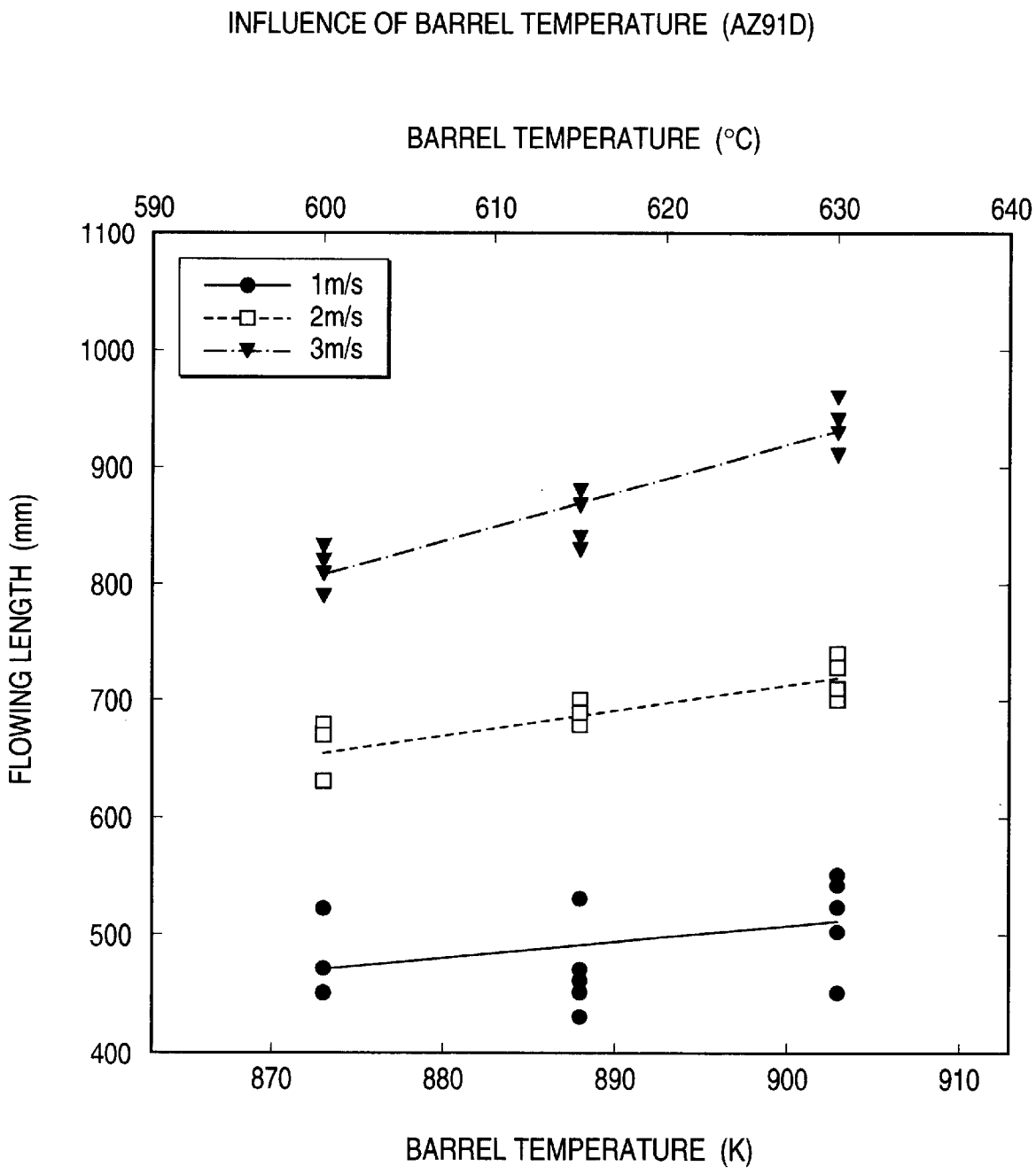
FIG. 2 is a graph showing the relationship between the barrel temperature and the flowing length of the molten metal in the conventional materials (AZ91D)

FIG. 2 is a graph showing, in the prior alloy, changes in the flowing length of filling the molten metal at the injection molding by changing the barrel temperature and the jetting speed, and evaluating influences of the barrel temperature and the jetting speed to the fluidity. As seen from this drawing, the jetting speed gives larger influences to the fluidity than the barrel temperature.

Next, an investigation was made to influences to the fluidity by the test samples by using raw material chips.

Influences of Al Content

Figure 3:
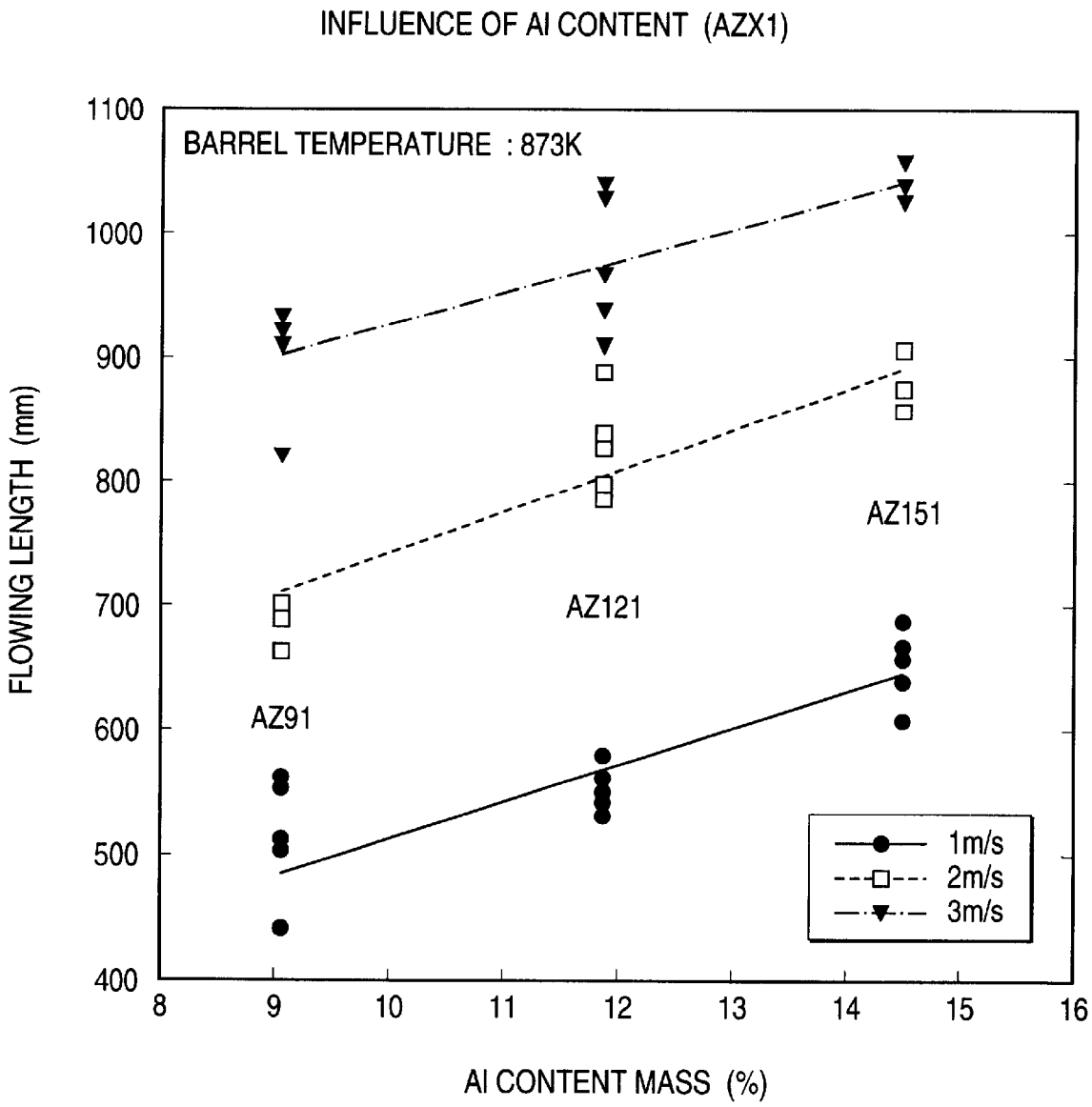
FIG. 3 is a graph showing the relationship between the Al content and the flowing length of the molten metal.

At first, the barrel temperature was made 873K constant, and the flowing lengths of filling the molten metal were compared among the raw material chips of the same parts except the Al content. The results are shown in FIG. 3, and as increasing the Al amount, the flowing lengths increase substantially straight. But when using the raw material chips of 14.5% Al, the formed bodies were cracked. Accordingly, it was seen that although the increase of Al heightened the fluidity but if exceedingly containing, the formed body was cracked.

Based on the reference of the 12% Al, the investigation was made to the influences to the fluidity by the Zn and Si contents.

Influences of Zn Content

Figure 4:
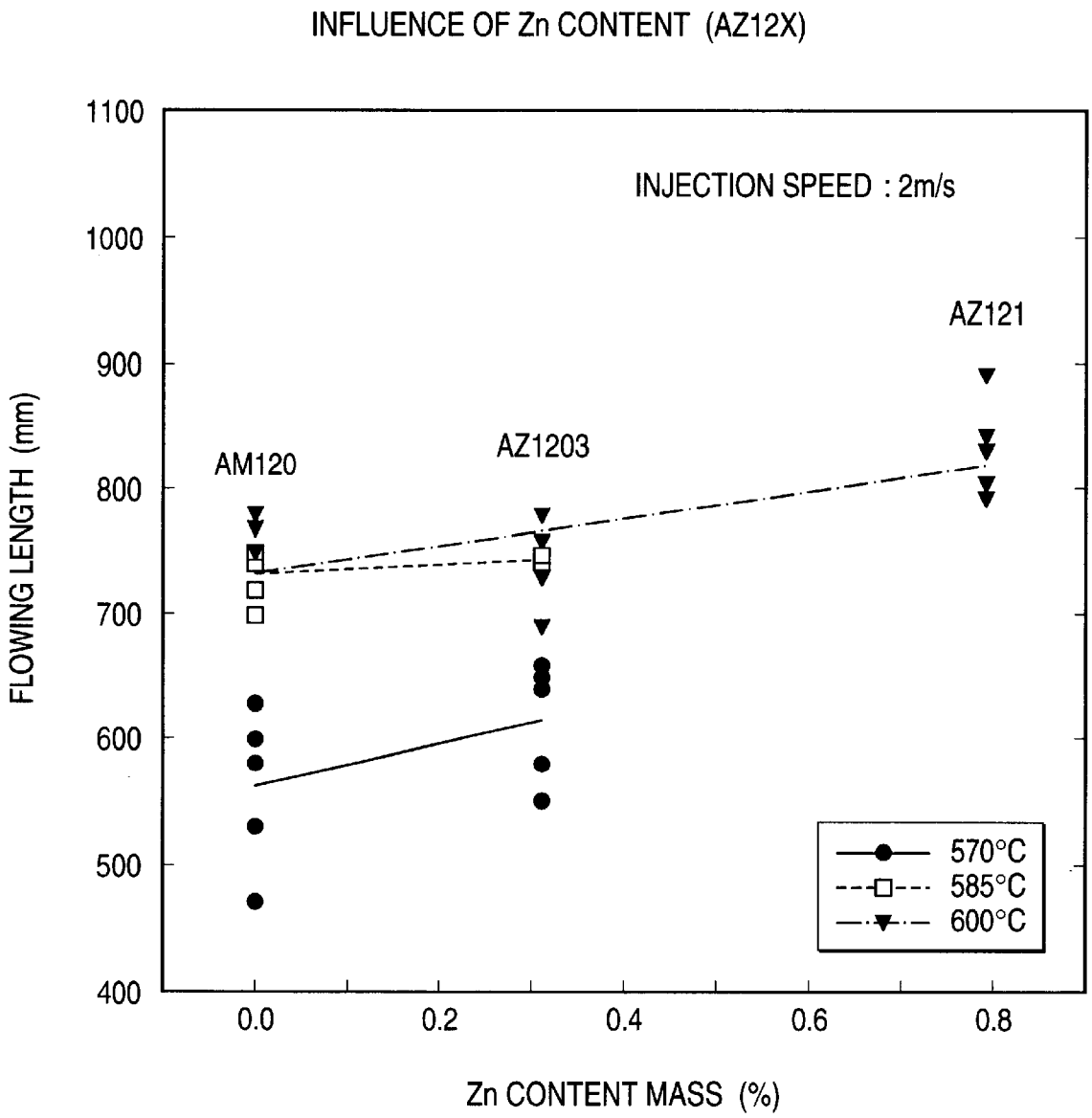
FIG. 4 is a graph showing the relationship between the Zn content and the flowing length of the molten metal.

For seeing the influence of Zn, the injecting speed was made constant at 2 m/s, the flowing lengths were compared among the raw material chips of the almost 12% Al and different in the Zn amount. The results are shown in FIG. 4. By containing Zn, the fluidity trends to go up, but when using the alloy of 0.8% Zn, it was difficult to form bodies at 858K or lower.

Influences of Si Content

Figure 5:
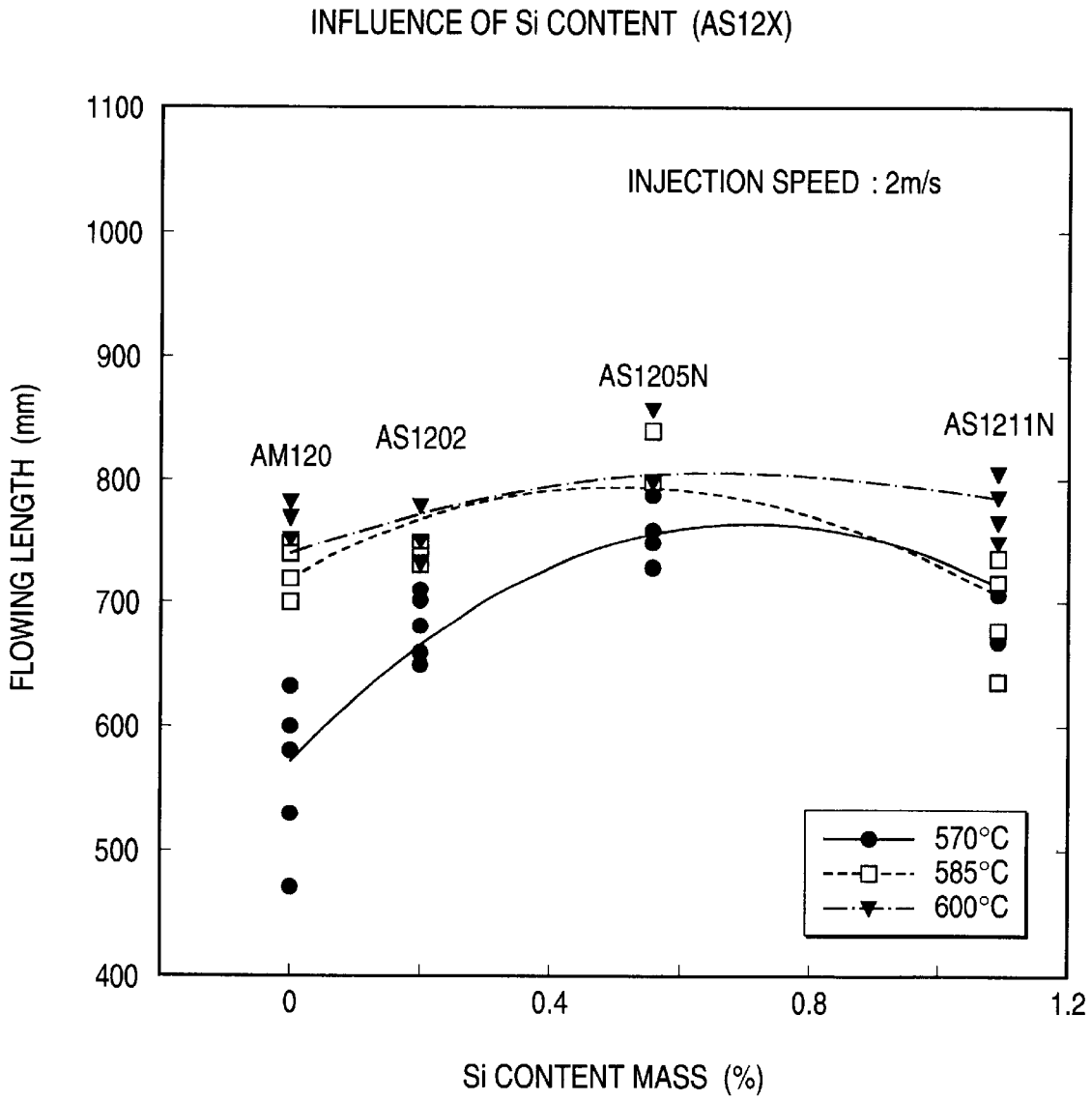
FIG. 5 is a graph showing the relationship between the Si content and the flowing length of the molten metal.

Similarly to the above, for seeing the influence of Si, the injecting speed was made constant at 2 m/s, the flowing lengths were compared among the raw material chips of the almost 12% Al and different in the Si amount. The results are shown in FIG. 5. By containing Si, the fluidity goes up, and this effect is remarkable when the barrel temperature is relatively low. The lower the barrel temperature, the lower the fluidity of the molten metal, and therefore, a formable temperature has a lower limit, but in the invention, since the fluidity at the low temperatures is improved by the content of Si, the forming is available at still lower temperatures. It was also confirmed that the improvement of the fluidity by the Si content was at peak around 0.5% Si.

Figure 6:
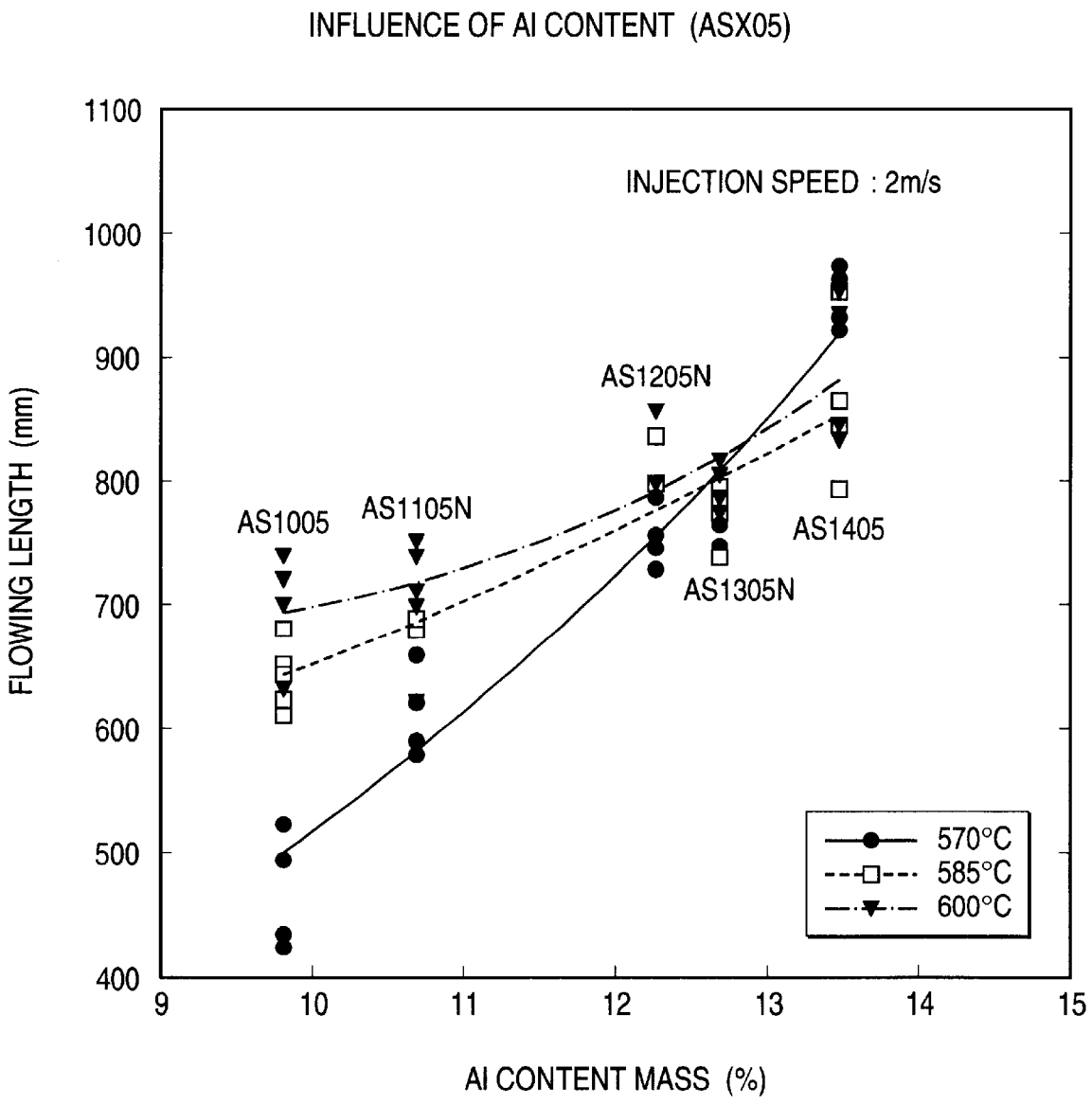
FIG. 6 is a graph showing the relationship between the Al content with 0.5% Si and the flowing length of the molten metal.

Further, for optimizing the elements, based on the reference of the 0.5% Si, the injecting speed was constant at 2 m/s, and the flowing lengths were again compared and evaluated among raw material chips of different Al contents. Results are shown in FIG. 6, and similarly to the results in FIG. 3, the fluidity goes up as increasing of Al, but the instant evaluation is more remarkable in the working. Accordingly, in the increase of the fluidity, it is assumed that Al and Si work synergistically. In the present evaluation, when using the alloying raw material of 13.5% Al, the formed bodies were cracked. Thus, similarly to the case of FIG. 3, by the increase of Al, the fluidity goes up, but it was seen that in alloys of appropriate Si content, cracks would be invited by Al exceeding 13%.

Figure 7:
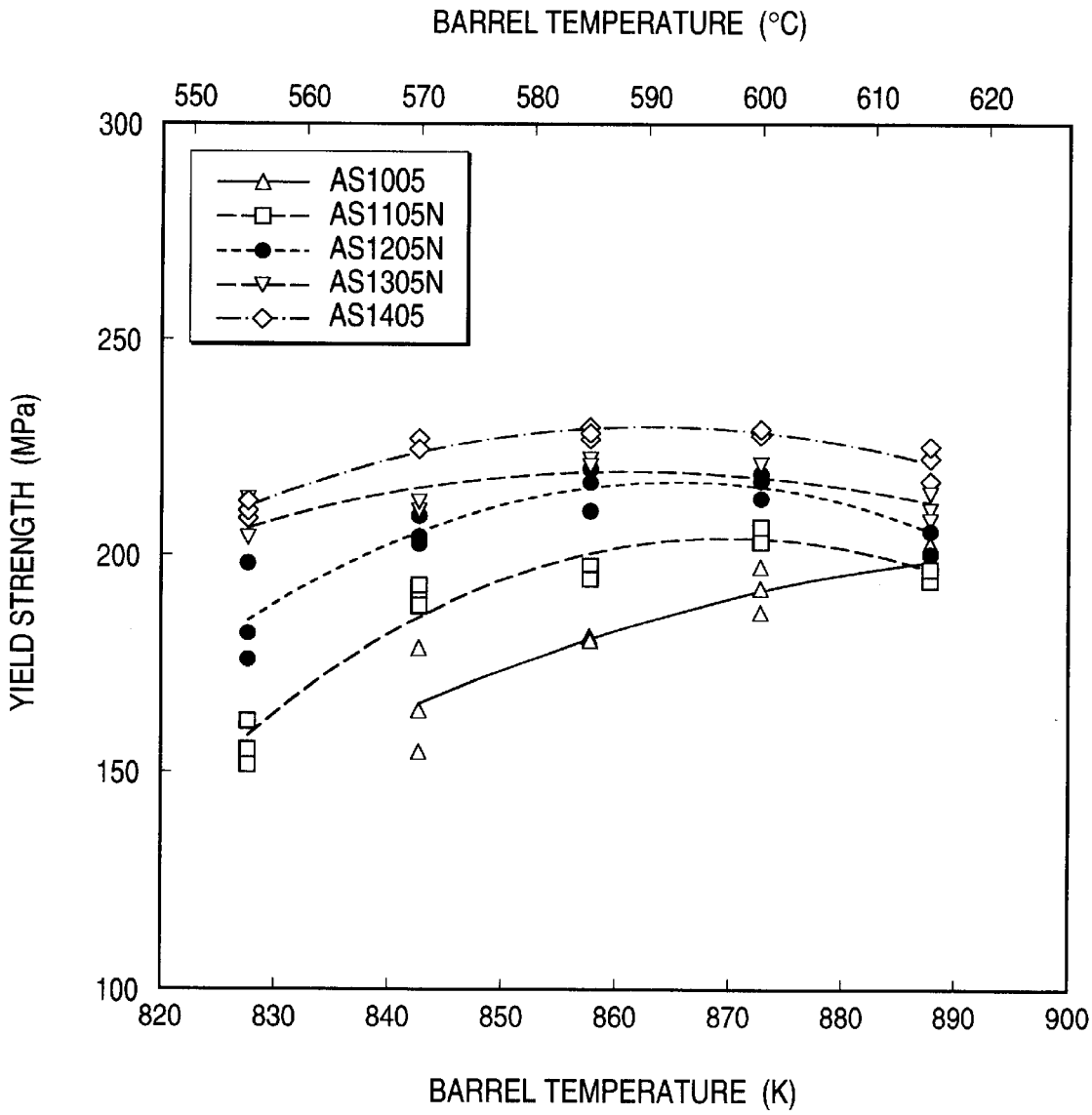
FIG. 7 is a graph showing the relationship between the barrel temperature and the yield strength at room temperatures with different Al content.
Figure 8:
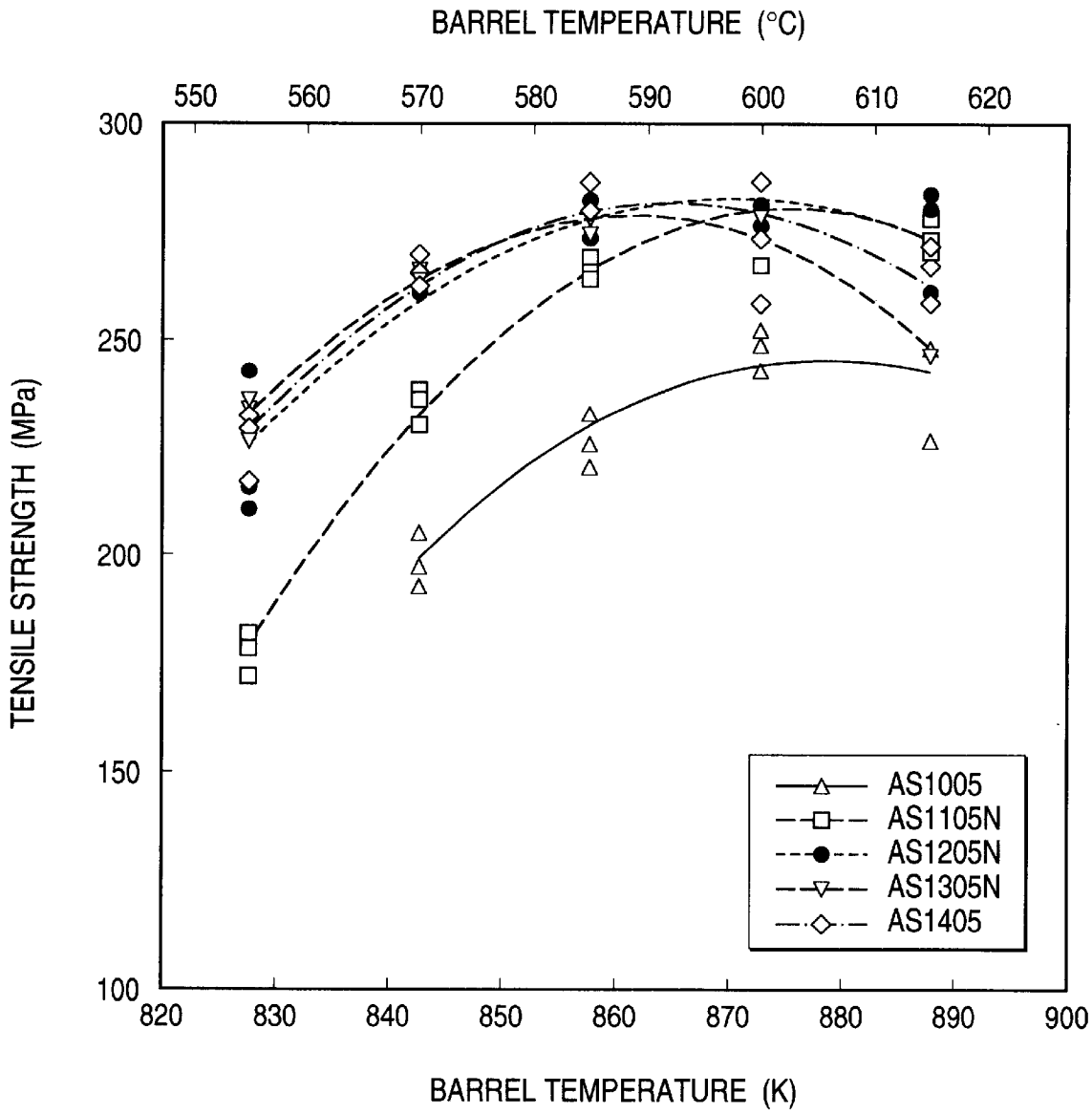
FIG. 8 is a graph showing the relationship between the barrel temperature and the tensile strength at room temperatures with different Al content.
Figure 9:
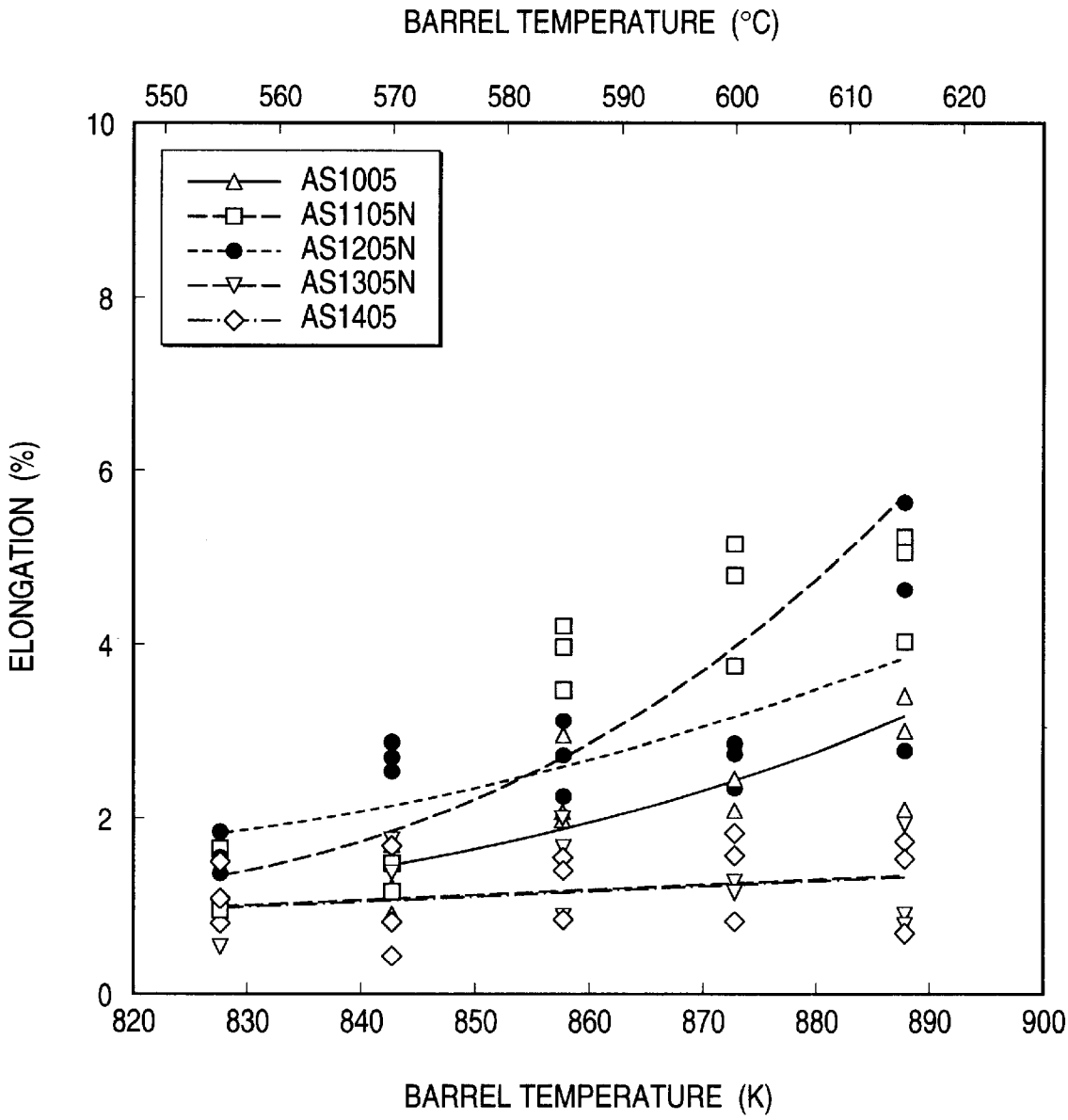
FIG. 9 is a graph showing the relationship between the barrel temperature and the elongation at room temperatures with different Al content.

For studying influences of the Al content to the mechanical properties at room temperatures, among raw material chips of different Al contents, the injection moldings were carried out by making the injection speed constant (2 m/s) and changing the barrel temperatures, and the obtained formed bodies were measured in yield strength, tensile strength and elongation. Results are shown in FIGS. 7 to 9. FIG. 7 shows the yield strength and FIG. 8 shows the tensile strength. It is seen that if Al is less than 10.0%, the yield strength and the tensile strength are low, and in particular when the barrel temperature is low, they are remarkably inferior. FIG. 9 shows the elongation of each of formed bodies, and the alloy of the invention shows the stabilized property irrespective of high and low barrel temperatures. Therefore, the formed body with the inventive alloy containing 12% Al shows the satisfied mechanical property at the room temperature. There occurs in the formed body of the 13.5% Al material having the relatively favorable mechanical property.

The above mentioned examples show the inventive materials each containing the specified Zn amounts, but when using the alloys of the inventive range without containing Zn, although somewhat decreasing, the substantially equivalent fluidity is available and it is confirmed that the same may be applied to the mechanical property. As mentioned above, since the magnesium alloys of the invention contain, by mass percent, Al: 10.0 to 13.0%, Si: 0.3 to 1.5%, Mn: 0.1 to 1.0%, and, if desired, Zn: less than 0.8%, the rest being Mg and unavoidable impurities, neither cracking by the casting is invited nor the mechanical property is spoiled, and the fluidity can be notably improved, and it is possible to make products small in thickness and light in weight.

Further, since the materials of the magnesium alloys of the invention are produced by the injection molding process of injecting the above mentioned alloys under the half molten condition being 50% or less in solid phase rate into the die, they have the preferable mechanical property, and the light weight may be easily realized.

TABLE 1

| Group | Names of Alloys | Alloy Components (mass %) Al | Mn | Si | Zn | Mg |
|---|---|---|---|---|---|---|
| Prior Material | AZ91 | 9.07 | 0.23 | <0.01 | 0.80 | Rest |
| Comparative materials. | AZ121 | 11.9 | 0.18 | <0.01 | 0.80 | Rest |
| | AZ151 | 14.5 | 0.19 | <0.01 | 0.77 | Rest |
| | AM120 | 11.7 | 0.27 | <0.01 | <0.01 | Rest |
| | AZ1203 | 11.6 | 0.19 | <0.01 | 0.32 | Rest |
| | AS1202 | 12.0 | 0.18 | 0.20 | <0.01 | Rest |
| Inventive materials | AS1205N | 12.3 | 0.17 | 0.56 | 0.16 | Rest |
| | AS1211N | 12.3 | 0.20 | 1.09 | 0.12 | Rest |
| Comparative materials | AS1005 | 9.80 | 0.23 | 0.50 | 0.18 | Rest |
| Inventive materials | AS1105N | 10.7 | 0.22 | 0.50 | 0.10 | Rest |
| | AS1305N | 12.7 | 0.22 | 0.51 | 0.10 | Rest |
| Comparative materials | AS1405 | 13.5 | 0.22 | 0.52 | 0.11 | Rest |

What is claimed is:

1. Magnesium alloys consisting essentially of mass percent Al: 10.0 to 10.7%, Si: 0.4 to 0.56%, Mn: 0.1 to 0.9%, Zn: less than 0.8%, 10 ppm to 800 ppm in total amount of one or two kinds of Be and Sr, the rest being Mg and unavoidable impurities.

2. Materials of magnesium alloys as set forth in claim 1, said materials are produced by a high pressure casting process of injecting the alloy under a semi solid condition being 50% or less in solid phase rate into a die.

* * * * *